US007241230B2

(12) United States Patent
Tsunoda

(10) Patent No.: US 7,241,230 B2
(45) Date of Patent: Jul. 10, 2007

(54) GOLF CLUB HEAD AND METHOD OF MAKING THE SAME

(75) Inventor: Masaya Tsunoda, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 0 days.

(21) Appl. No.: 10/635,031

(22) Filed: Aug. 6, 2003

(65) Prior Publication Data

US 2004/0048685 A1 Mar. 11, 2004

(30) Foreign Application Priority Data

Aug. 6, 2002 (JP) ..... 2002-229043

(51) Int. Cl.
*A63B 53/04* (2006.01)

(52) U.S. Cl. ..... 473/324; 473/346

(58) Field of Classification Search ..... 473/332, 473/345, 346

See application file for complete search history.

(56) References Cited

U.S. PATENT DOCUMENTS 4,928,965 A 5/1990 Yamaguchi et al.
6,123,629 A * 9/2000 Yamaguchi et al. ..... 473/372
6,348,013 B1 * 2/2002 Kosmatka ..... 473/329
6,354,962 B1 * 3/2002 Galloway et al. ..... 473/342
6,402,639 B1 * 6/2002 Iwata et al. ..... 473/330
6,533,681 B2 * 3/2003 Inoue et al. ..... 473/342
7,086,963 B1 * 8/2006 Onuki et al. ..... 473/342

FOREIGN PATENT DOCUMENTS

JP 61-22874 A 1/1986
JP 2002-17904 A 1/2002
JP 61-284265 A 12/2002

* cited by examiner

*Primary Examiner*—Stephen Blau
(74) *Attorney, Agent, or Firm*—Birch, Stewart, Kolasch & Birch, LLP

(57) ABSTRACT

A golf club head containing a face portion having a front face defining a club face for hitting a ball and a hollow portion provided behind the face portion, wherein the frequency F(fix) of a local minimum value of the first-order vibration mode in a frequency response function of the club head obtained by vibrating an input point on the club face and measuring the response at an output point on the club face is in a range of from 200 to 1400 Hz; and the frequency F(free) of the smallest local minimum value of a frequency response function of the club head obtained by hitting the input point and measuring the response at the output point is in a range of from 5000 to 9000 Hz.

6 Claims, 12 Drawing Sheets

Model 1

Model 2

Model 3

Model 4

GOLF CLUB HEAD AND METHOD OF MAKING THE SAME

This nonprovisional application claims priority under 35 U.S.C. § 119(a) on patent application No(s). 2002-229043 filed in JAPAN on Aug. 6, 2002, which is(are) herein incorporated by reference.

BACKGROUND OF THE INVENTION

The present invention relates to a golf club head and a method of making the golf club head, and more particularly to a method of adjusting the mechanical impedance of a club head to the golf ball for improving the rebound performance.

In the U.S. Pat. No. 4,928,965 filed based on the following two Japanese patent applications JP-A-61-22874 and JP-A-61-284265, the so called impedance matching theory is proposed. This theory teaches that, when the primary (1st-order) frequency of the mechanical impedance of a golf club head is matched with the primary (1st-order) frequency of the mechanical impedance of the golf ball, a loss of the energy transferred from the golf club head to the struck golf ball is reduced and, as a result, the rebound performance may be improved to increase the golf ball carry.

In the laid-open Japanese patent application JP-A-61-22874 (JP-B-4-56630), it is proposed to design a club head such that the primary frequency of the mechanical impedance of the club head falls within a frequency range of from 2500 to 4000 Hz under a state like the undermentioned strung-up free state.

In the laid-open Japanese patent application JP-A-61-284265 (JP-B-5-33071), on the other hand, it was proposed to design a club head such that the primary frequency of the mechanical impedance of the club head falls within a frequency range of from 600 to 1600 Hz under a state like the undermentioned face-fixed state.

Also in the laid-open Japanese patent application P2002-17904A, it was proposed to design a club head such that the natural vibration frequency of the club head becomes less than 600 HZ under a state like the face-fixed state.

The the present invention has realized that the mechanical impedance of a club head and frequency response function thereof vary depending on the measuring conditions and/or methods, and the present invention further studied to improve the rebound performance of a club head. As a result, optimal conditions were discovered, namely, by designing the club head to satisfy specific conditions in two different measuring methods performed under different conditions, whereby the rebound performance can be further unexpectedly improved.

SUMMARY OF THE INVENTION

It is therefore, an object of the present invention to provide a golf club head and a method of making the same, in which the rebound performance is improved to increase the traveling distance of the struck golf ball.

According to one aspect of the present invention, a golf club head comprises a face portion with a front face defining a club face for hitting a golf ball and a hollow portion disposed behind the face portion, wherein a frequency F(fix) of a local minimum value of the first-order vibration mode in a frequency response function of the club head obtained by vibrating an input point on the club face and measuring the response at an output point on the club face is in a range of from 200 to 1400 HZ, and a frequency F(free) of the smallest local minimum value of a frequency response function of the club head obtained by hitting the input point and measuring the response at the output point is in a range of from 5000 to 9000 HZ.

According to another aspect of the present invention, a method of making a golf club head comprises setting a frequency F(fix) in a range of from 200 to 1400 HZ, wherein the frequency F(fix) is the frequency of a local minimum value of the first-order vibration mode in a frequency response function of the club head measured with a vibrator method, and setting a frequency F(free) in a range of from 5000 to 9000 HZ, wherein the frequency F(free) is the frequency of the smallest local minimum value of a frequency response function of the club head measured with an impact hammer method.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein:

FIG. 10(*b*) is a cross sectional view taken along a line B-B of FIG. 10(*a*).

DESCRIPTION OF THE PREFERRED EMBODIMENTS

Embodiments of the present invention will now be described in detail in conjunction with the accompanying drawings.

Figure 1:
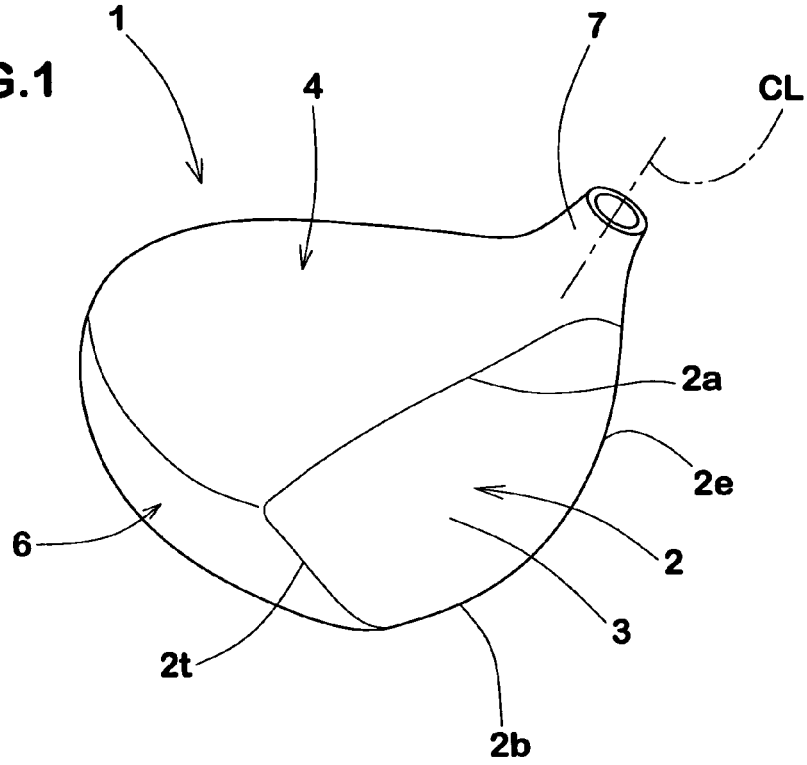
FIG. 1 is a perspective view of a club head according to the present invention.
Figure 2:
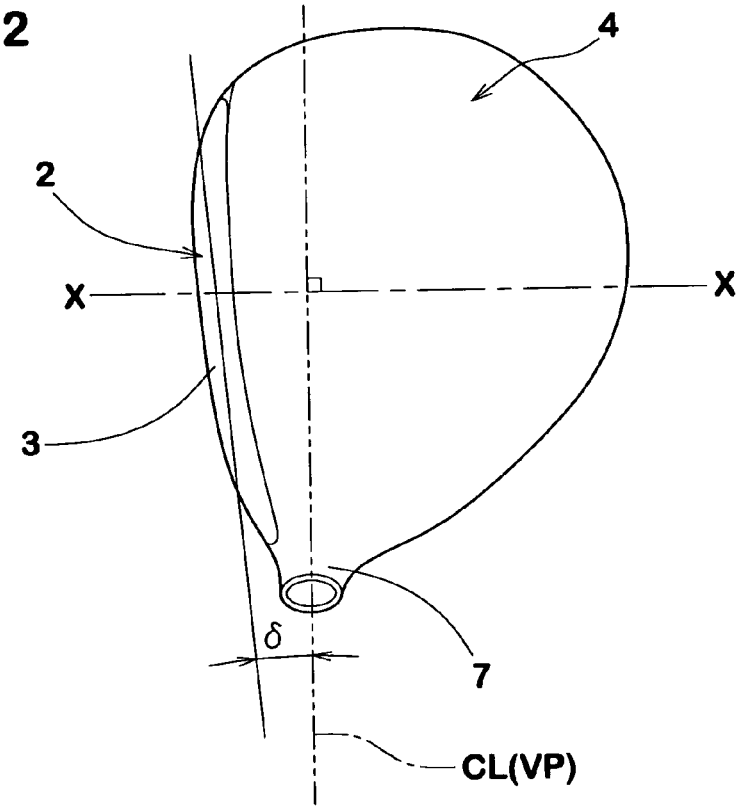
FIG. 2 is a top view of the club head.
Figure 3:
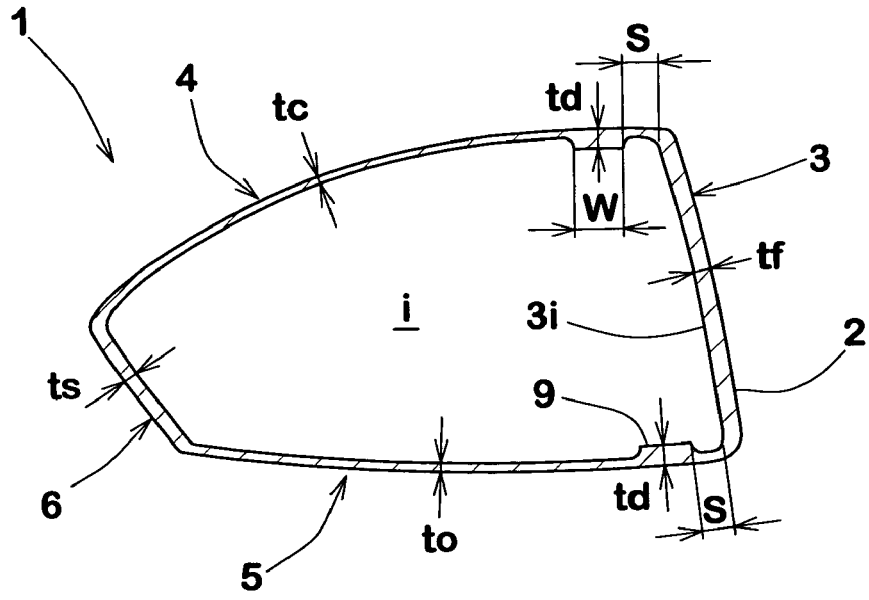
FIG. 3 is a cross sectional view taken along a line x-x of FIG. 2.

In FIGS. 1 to 3, club head 1 according to the present invention is a wood-type hollow metal head 1 which comprises a face portion 3 whose front face defines a club face 2 for striking a ball, a crown portion 4 intersecting the club face 2 at the upper edge 2*a* thereof, a sole portion 5 intersecting the club face 2 at the lower edge 2*b* thereof, a side portion 6 between the crown portion 4 and sole portion 5 which extends from a toe-side edge 2*t* to a heel-side edge 2*e* of the club face 2 through the back face of the club head, and a neck portion 7 to be attached to an end of a club shaft (not shown). The neck portion 7 is disposed near the heel-side intersection of the above-mentioned face portion 3, crown portion 4 and side portion 6.

In FIGS. 1 to 3, the club head 1 is put under a measuring state where the head is set on a horizontal plane such that the axis of the club shaft(or the center line CL of the shaft inserting hole provided in the neck portion 7) is inclined at its lie angle while keeping the center line CL on a vertical plane VP, and the club face 2 forms its loft angle with respect to the horizontal plane and its face angle δ with respect to the vertical plane VP.

According to the present invention, the frequency response function of the club head has the first-order (primary) frequency F(fix) of from 200 to 1400 Hz when measured by the undermentioned vibrator method. But, measured by the undermentioned impact hammer method, the frequency F(free) at which the frequency response function of the club head shows the minimum value (which means the smallest in the local minimal values) falls in a range of from 5000 to 9000 Hz.

Vibrator Method

In the vibrator method, the club face 2 is vibrated by a vibrator fixed to the club face 2, and at the vibrating point S of the club face, the input is measured with a sensor. At the same time, the response or output is measured with a sensor at a predetermined point T on the club face (hereinafter, the "output point T"), and the frequency response function is obtained from the input and output detected by the sensors.

As to the vibrating point S, the so called sweet spot of the club face 2 is used in order to minimize the moment which may be caused by the vibrating motion.

The sweet spot is defined as a point of intersection between the club face 2 and a straight line drawn from the center of gravity of the club head perpendicularly to the club face. In practice, the sweet spot may be defined as a point on the club face at which the head placed with the face down can achieve a balance on the tip of the perpendicular pipe whose outside diameter is 2.5 mm.

Figure 4:
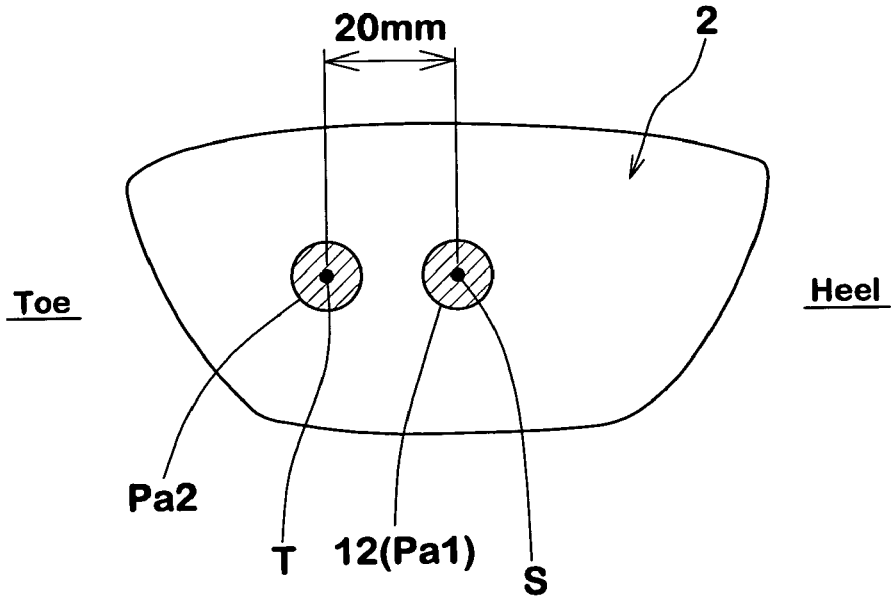
FIG. 4 shows the club face for explaining the input point for vibrating or hitting and the output point for measuring the response.

On the other hand, the output point T is, as shown in FIG. 4, defined as a point on the club face 2 at a distance of 20 mm toward the toe from the sweet spot s along a horizontal line passing the sweet spot s under the above-mentioned measuring state.

Figure 5:
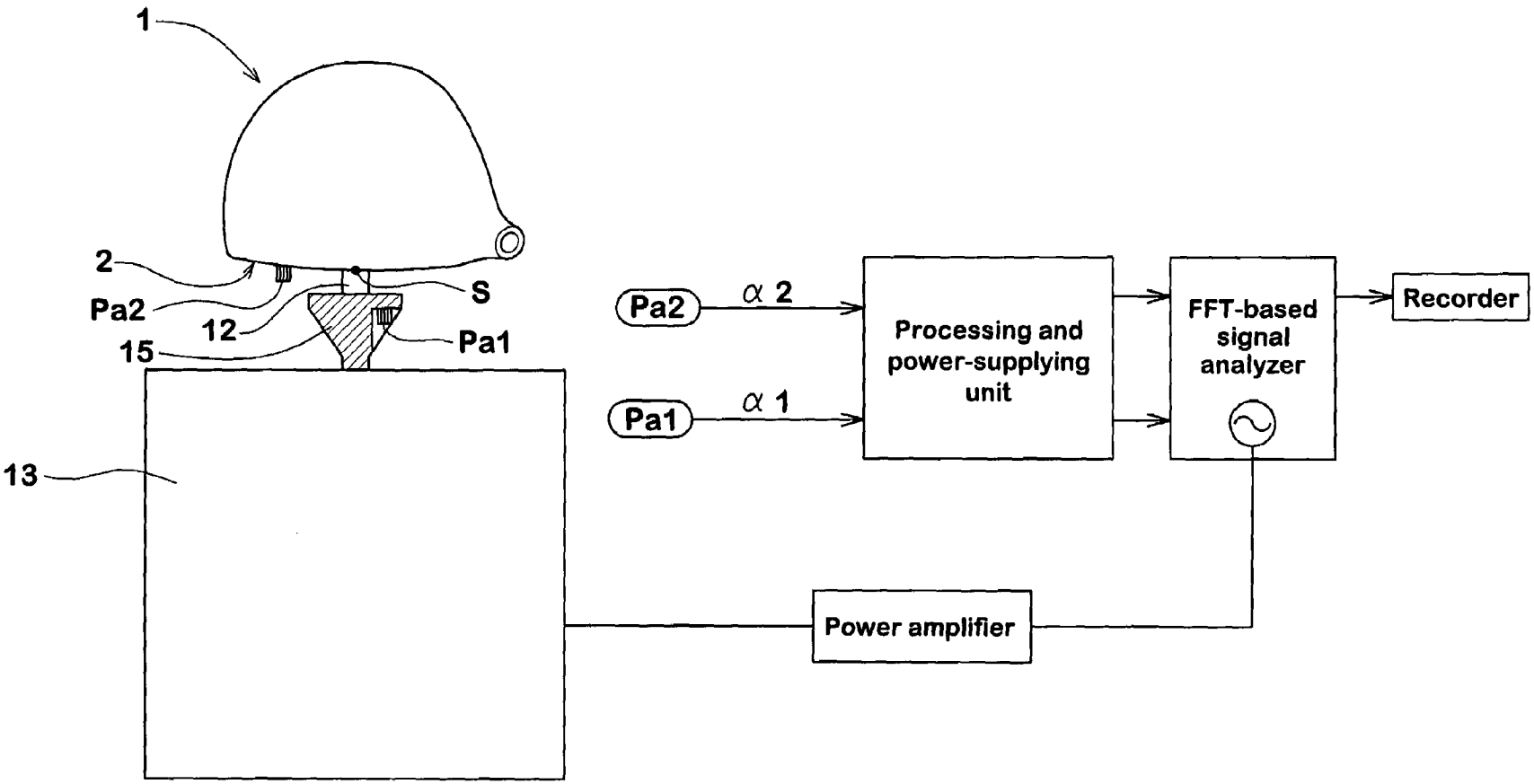
FIG. 5 is a diagram for explaining the vibrator method.

FIG. 5 shows a system of measuring the frequency response used in this embodiment.

In this system, an acceleration pickup Pa1 is used as the sensor for the input (input=acceleration α1), and an acceleration pickup Pa2 is used as the sensor for the output (output=acceleration α2). The club head alone with the face down is fix to the top end of a cylindrical output rod 12 of a transducer 13 using an adhesive agent. The outside diameter of the cylindrical rod 12 is 10 mm, and the fixed position is the sweet spot S.

The acceleration pickup Pa1 is fixed to the rod 12 using an adapter 15 to measure the acceleration at the vibrating point S of the club head.

The acceleration pickup Pa2 is fixed to the above-mentioned point T of the head using an adhesive agent.

During a sweep signal generated by an oscillator and applied to the transducer 13 through a power amplifier to vibrate the club head, the output signals α1 and α2 of the sensors are given to a signal analyzer through a processing and power-supplying unit to perform a power spectrum analysis based on fast Fourier transform and obtain the frequency response function(=power spectrum of acceleration α1/power spectrum of acceleration α2).

Figure 6:
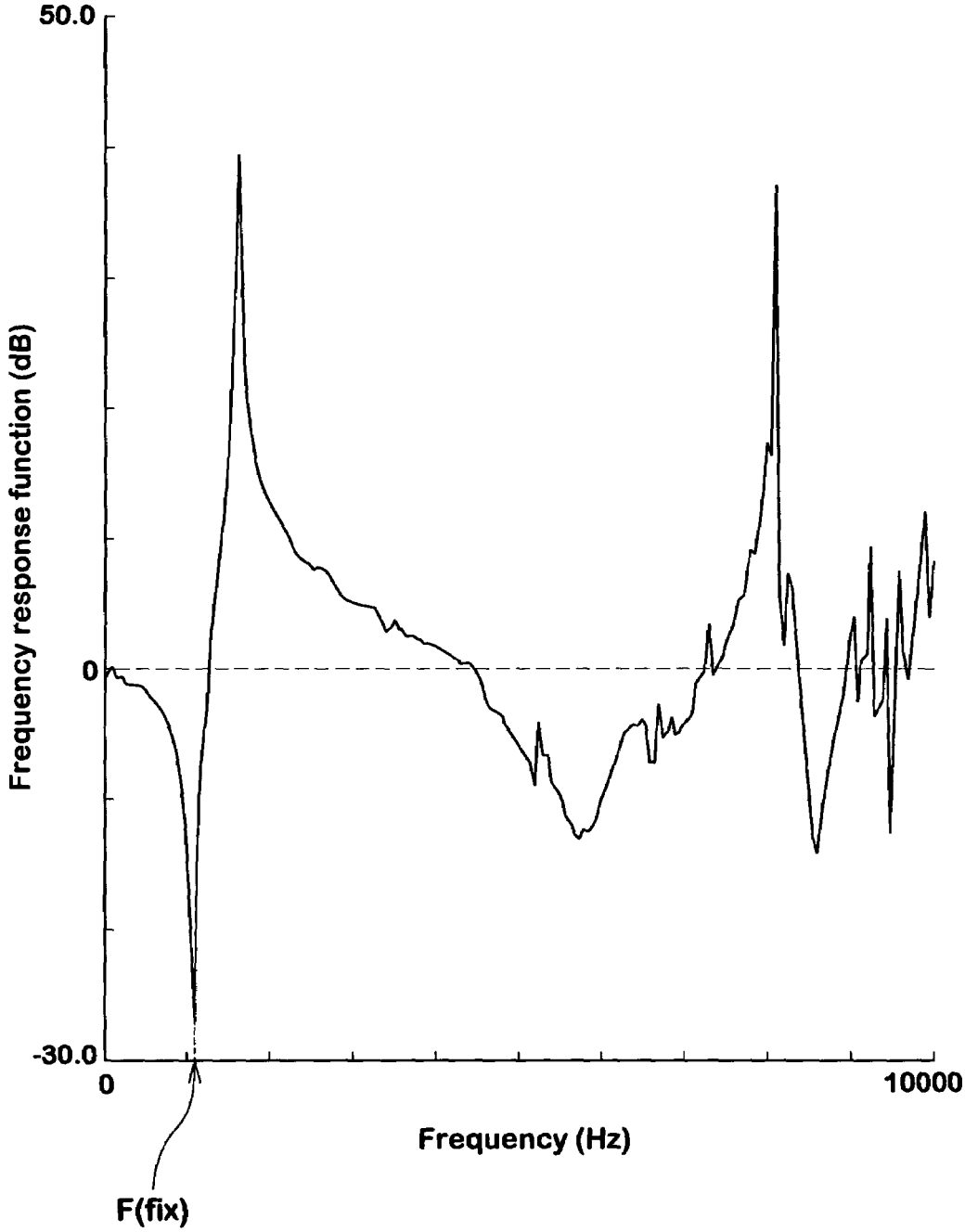
FIG. 6 is a graph showing a frequency response function of a club head found by the vibrator method.

FIG. 6 shows an exemplary graph of the frequency response function. From such a graph, the frequency at which a local minimum value on the first-order vibration mode occurs is read as the frequency F(fix). In other words, the lowest in the frequencies of local minimum values is set as the frequency F(fix).

Impact Hammer Method

The club head (alone or together with the shaft) is strung up with the club face being free, and the club face is hit, using an impact hammer. The impact force F1 (input force) by the hammer is measured with a sensor, and the response or output is measured with a sensor fixed at the above-mentioned output point T, and the frequency response function is obtained from the sensor outputs.

Figure 7:
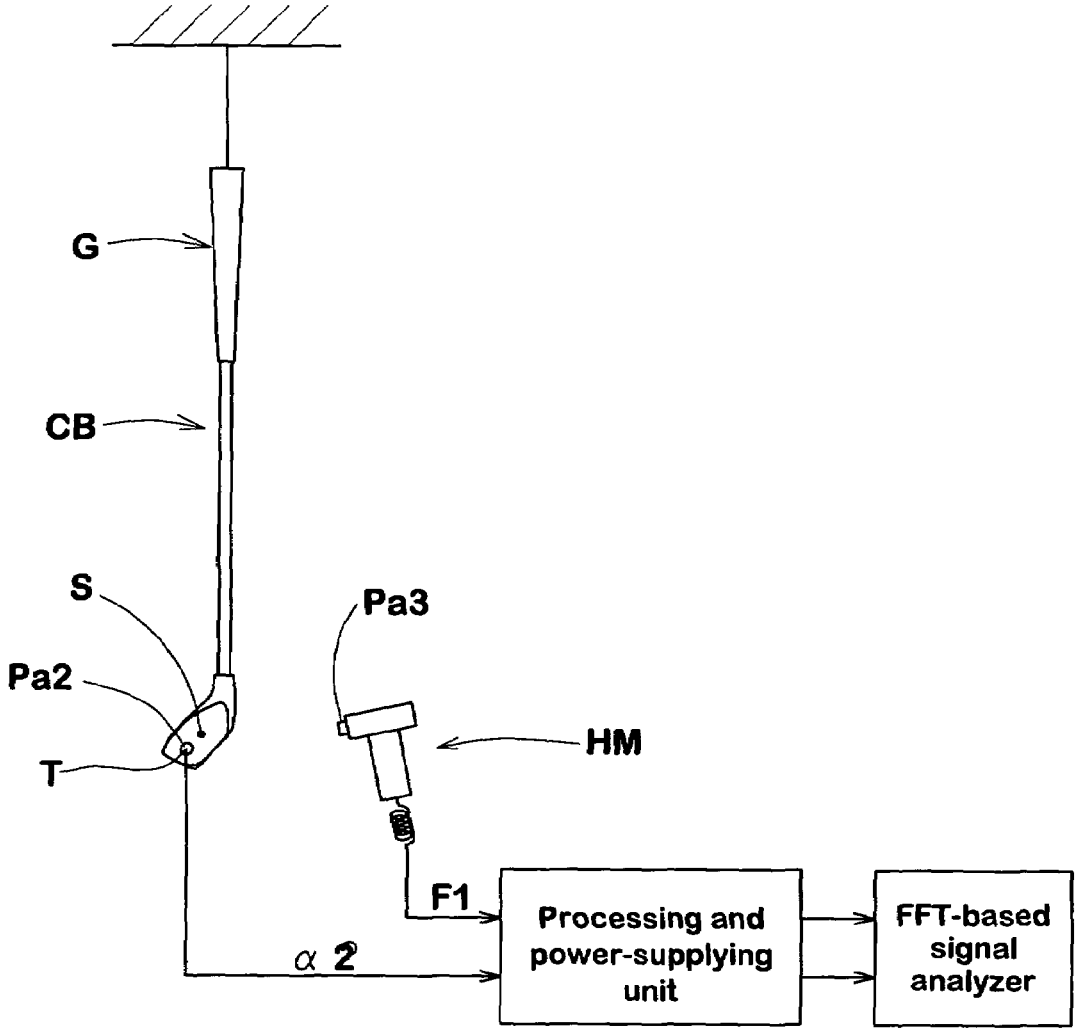
FIG. 7 is a diagram for explaining the impact hammer method.
Figure 8:
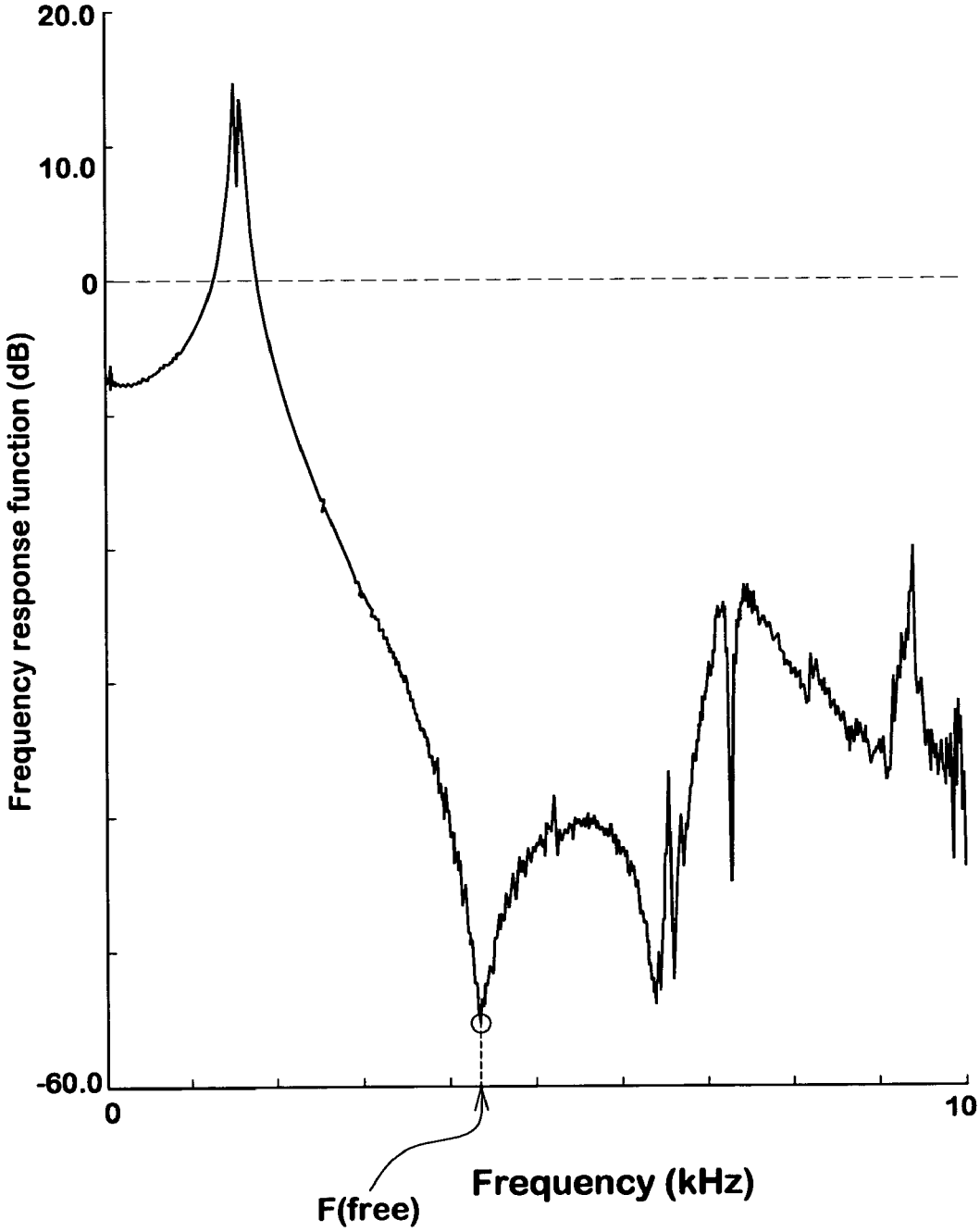
FIG. 8 is a frequency response function of the same club head found by the impact hammer method.

FIG. 7 shows a system of measuring the frequency response used in this embodiment. In this system, the golf club CB is hanged with a string tied to the grip G.

The above-mentioned acceleration pickup Pa2 fixed to the face at the point T is used as the sensor for the response (thus, output=acceleration α2'). The point hit by the hammer HM (hereinafter, the "hitting point") is the sweet spot S of the club face. In this method, as the sensor for the impact force, a pressure sensor Pa3 attached to the impact hammer is used. (Thus, output=pressure F1). The output signals F1 and α2 of the sensors are given to the signal analyzer through the processing and power-supplying unit to perform a power spectrum analysis based on fast Fourier transform and obtain the frequency response function(=power spectrum of pressure F1/power spectrum of acceleration α2').

The obtained frequency response function may have plurality local minimum values of from the first-order to n-th order modes. The frequency of the lowest in the local minimum values is set to the frequency F(free).

Figure 9:
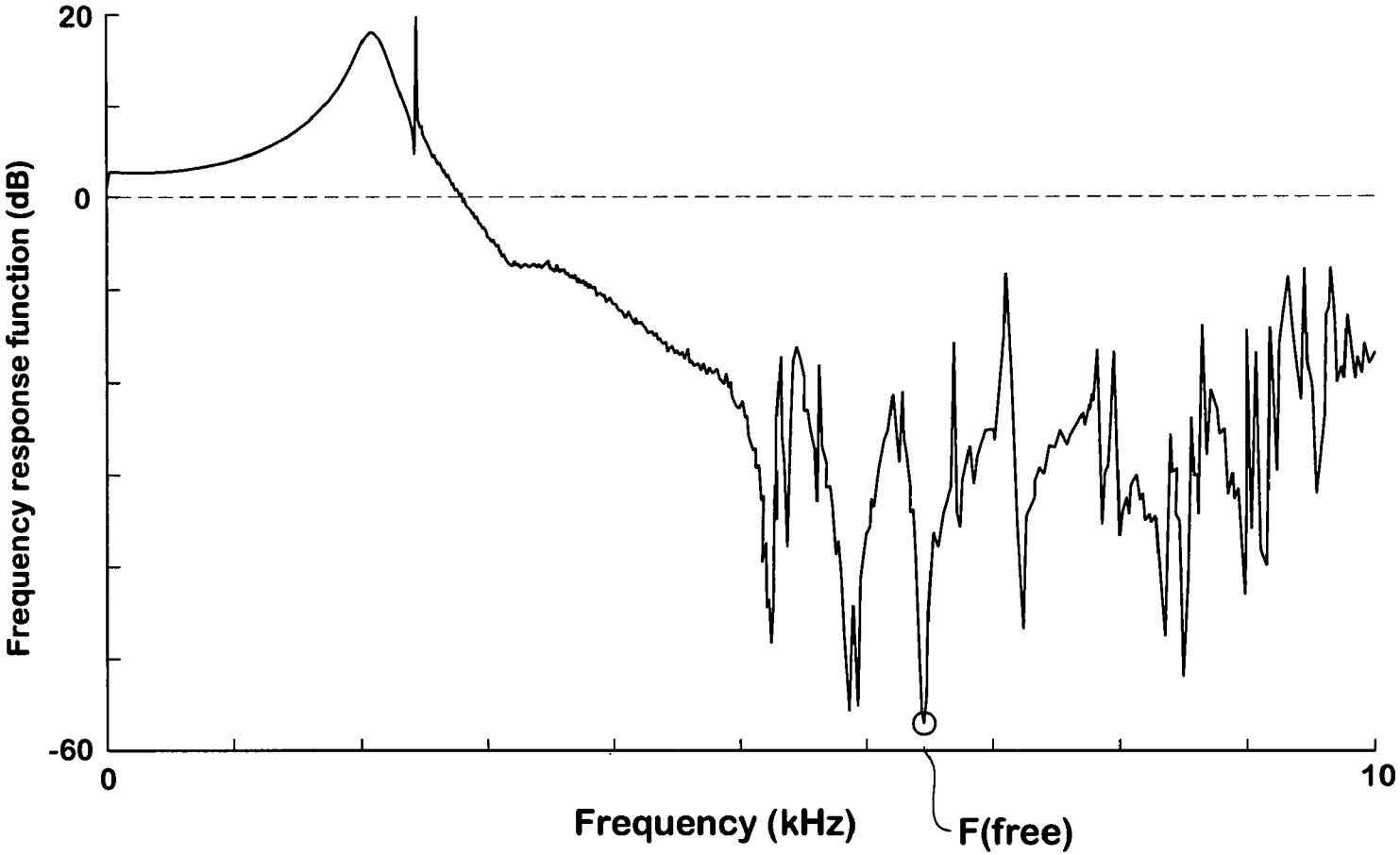
FIG. 9 is a frequency response function of another club head found by the impact hammer method.

IG. 8 is a graph showing an example of the frequency response function. In this case, the local minimum value of the first-order vibration mode is smallest. Thus, this frequency is F(free). However, in FIG. 9 which shows another example of the frequency response function, the third-order vibration mode is smallest. Thus, this frequency is F(free).

In the free state, it is necessary for improving the rebound performance to place great importance on a vibration mode in which the vibrational amplitude of the face portion becomes maximum. Therefore, the frequency at the absolutely minimum value (not always the first-order) is used as the frequency F(free).

The following equipment was used in the two methods.

Signal Analyzer: HP3562A (Yokogawa Hewlett-Packard)

vibrator: Transducer: 513A (ShinNihon sokki)

Power amplifier: 360-B (ShinNihon sokki)

Acceleration pickup Pa1: 353B17 (PCB Piezotronics Inc.)

Acceleration pickup Pa2: 352B22 (PCB Piezotronics Inc.)

Impact hammer: D86B03 (PCB Piezotronics Inc.)

Processing and power-supplying unit: 482A18 (PcB Piezotronics Inc.)

The inventor conducted various studies including numerical analyses such as FEM analysis to improve the rebound performance, and as a result found that there may be a further factor of improving the rebound performance to be considered together with the impedance matching theory.

Figure 10A:
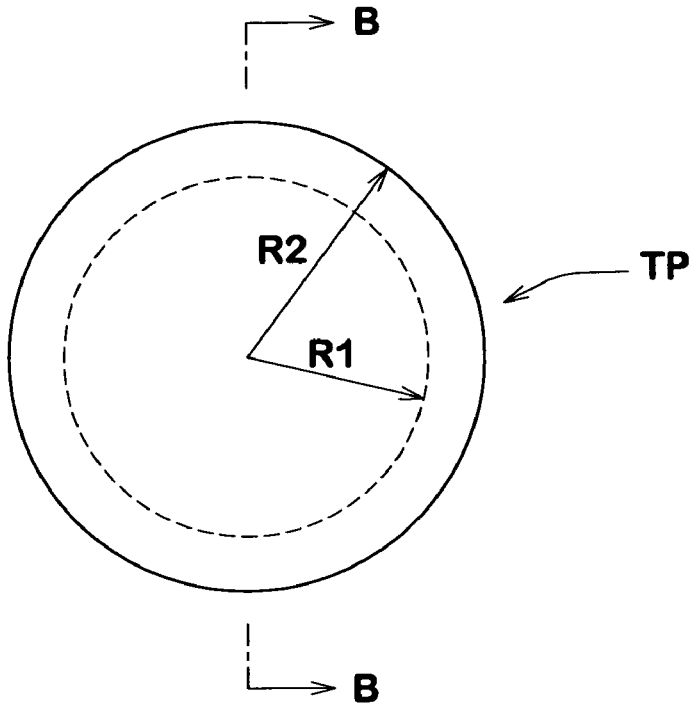
FIG. 10(*a*) is a front view of a face plate test model.
Figure 10B:
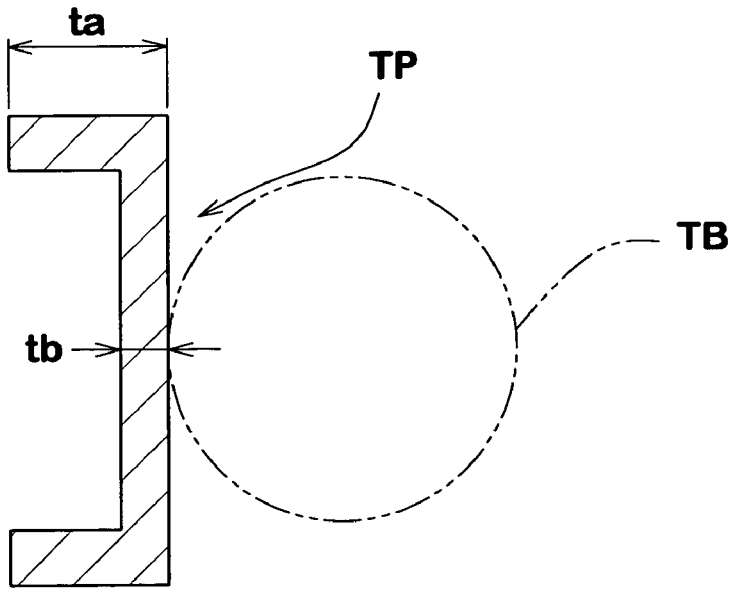
Figure 11A:
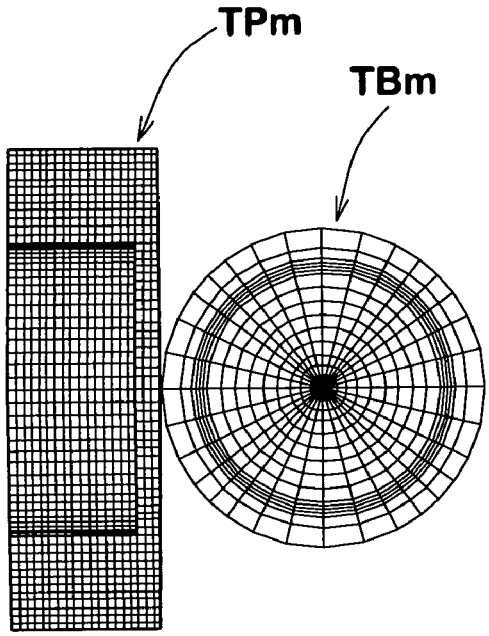
FIG. 11(*a*) to (*d*) show collision simulation results visualized in a cross sectional view.
Figure 11B:
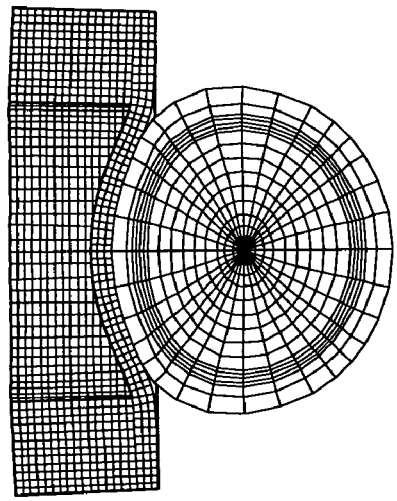
Figure 11C:
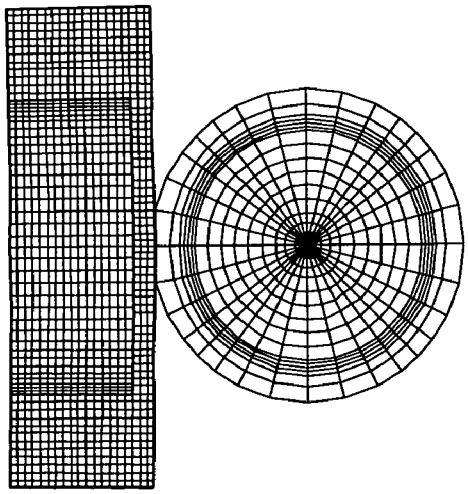
Figure 11D:
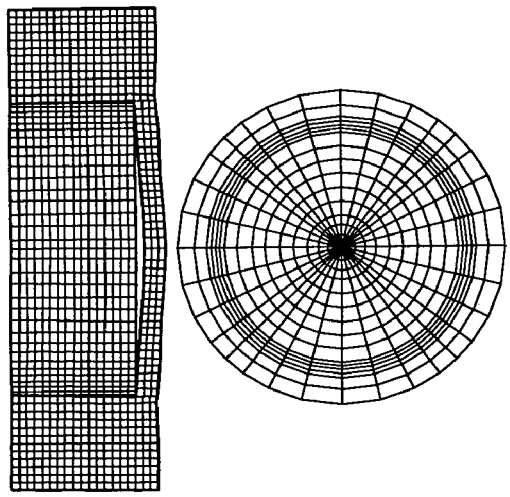

FIGS. 10(*a*) and 10(*b*) show a simplified model of a face plate (face portion 3) used in the FEM analysis.

FIGS. 11(*a*), 11(*b*), 11(*c*) and 11(*d*) show a finite element model TP of the above-mentioned simplified model and a finite element model TB of a golf ball as computer outputs showing the course of collision simulation.

The face plate model TP is a circular plate having a flat front surface and provided on the back side with a flange (thickness ta) surrounding the platy portion (thickness tb).

In the FEM analysis, the restitution coefficient was computed using these finite element models TP and TB, while changing boundary conditions for the face plate model TP relating to the dimensions, modulus and the like as shown in Table 1 to change the frequency F(fix) and frequency F(free) of the face plate model TP. However, F(fix) and F(free) for the golf ball model were fixed at typical values (F(fix)=1041 Hz, F(free)=3588 HZ).

Firstly, the frequencies F(fix) and F(free) of the face plate model TP were computed. Then, in order to simulate collision between the two models and compute the restitution coefficient of the face plate model in accordance with the "Procedure for Measuring the velocity Ratio of a club Head for conformance to Rule 4-1e, Appendix II, Revision 2 (Feb. 8, 1999), United states Golf Association", the conditions specified in the above-mentioned Procedure were set as the boundary conditions as much as possible, namely, the ball model TB was hit against the face plate model TPm at its sweet spot (center) at the incoming ball velocity Vi of 48.77 meter/second, and the rebound velocity Vo of the golf ball model TBm was computed. Using the rebound velocity Vo, the mass (m) of the golf ball and the mass M (=200 grams) of the face plate model TP, the restitution coefficient e was computed, using the following equation (Vo/Vi)=(eM−m)/(M+m).

Figure 12B:
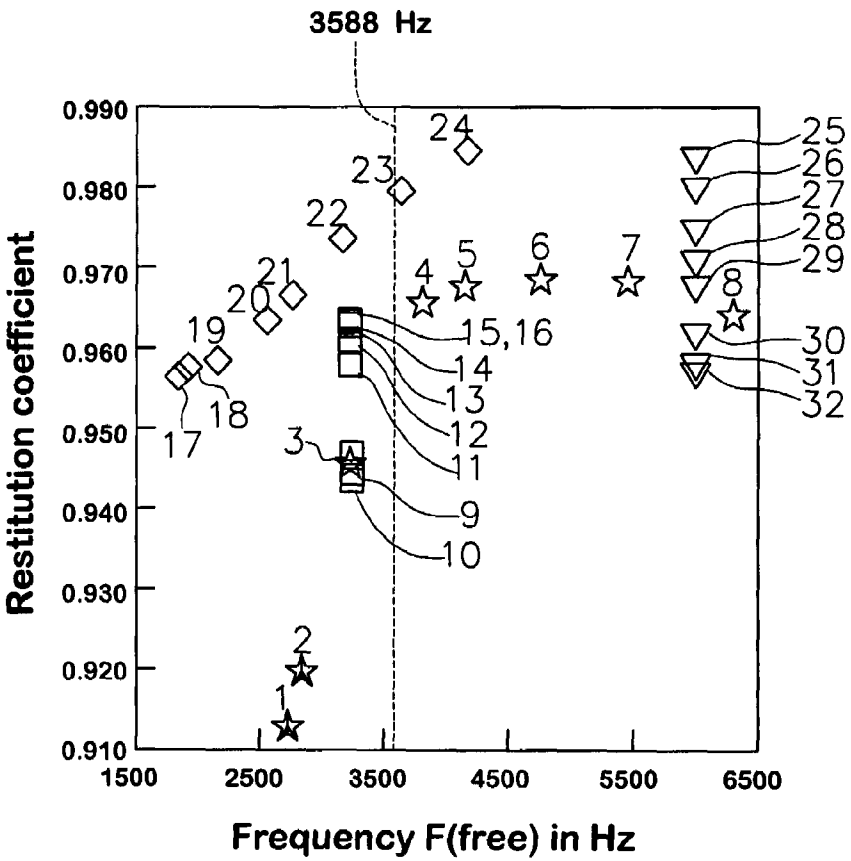
FIGS. 12(*a*) and (*b*) are graphs showing collision simulation results.
Figure 12A:
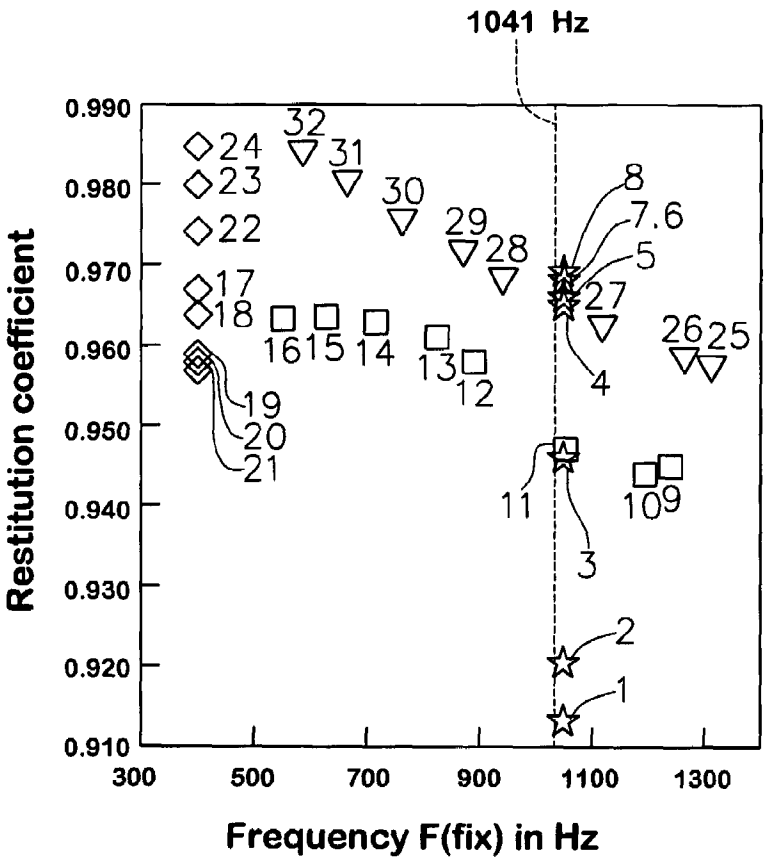
Figure 13A:
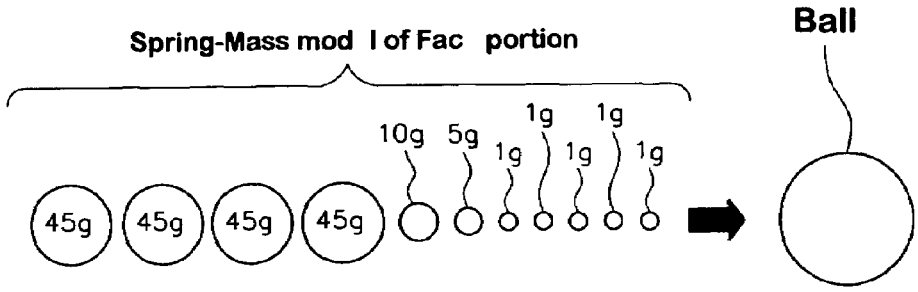
FIG. 13(*a*) to (*d*) show examples of spring-Mass model of a club head.
Figure 13B:
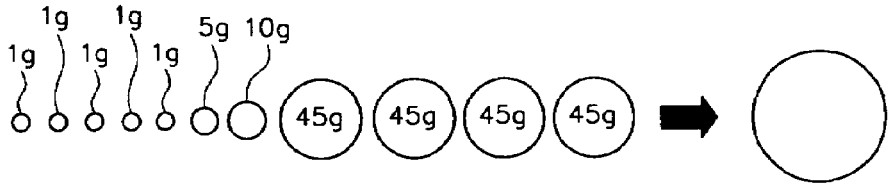
Figure 13C:
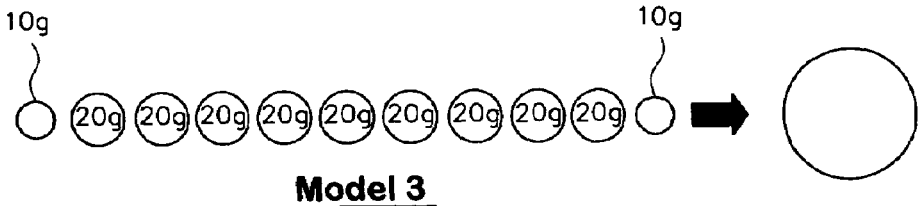
Figure 13D:
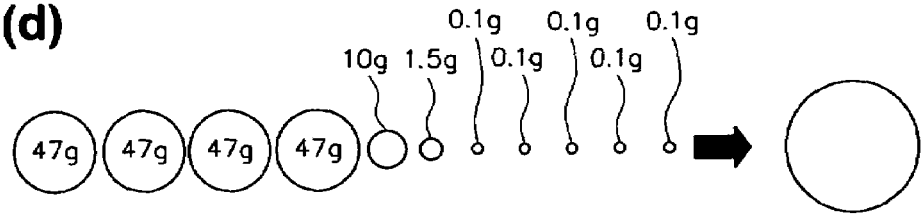

The simulation results are shown in Table 1, and also plotted in FIG. 12(*a*) and FIG. 12(*b*) together with numerals indicating the face plate model No.

In the face plate model Nos. 1 to 8, the frequency F(fix) of the face plate is adjusted to that of the ball (=1049 HZ), and the frequency F(free) of the face plate is varied by changing the Young's modulus of the face plate and the thickness ta of its peripheral part. AS shown in FIG. 12(*b*), the face plate model Nos. 1 to 8 show that the restitution coefficient increases with the frequency F(free) increases, and the restitution coefficient has a tendency to increase even when the frequency F(free) of the face plate model is increased over the frequency F(free) of the ball which is 3588 Hz.

In the face plate model Nos. 9 to 16, the frequency F(free) of the face plate is adjusted to that of the ball (=3234 Hz), and the frequency F(fix) of the face plate model is varied by changing the Young's modulus of the face plate model and the thickness ta of its peripheral part. As shown in FIG. 12(*a*), the face plate model Nos. 9 to 16 show that the restitution coefficient is improved as the frequency F(fix) decreases, and the restitution coefficient has a tendency to increase continuously even when the frequency F(fix) of the face plate model is decreased below the frequency F(fix) of the ball (=1041 Hz).

In the face plate model Nos. 17 to 24, the frequency F(fix) of the face plate was set at 400 Hz which is below the frequency F(fix) of the ball. As shown in FIG. 12(*b*), the face plate model No. 17 to 24 show that the restitution coefficient has a tendency to increase continuously even when the frequency F(free) of the face plate model increases over the frequency F(free) of the ball (=3588 Hz). Like the model Nos. 1 to 8, the face plate model No. 17 to 24 also show that the restitution coefficient increases as the frequency F(free)

TABLE 1

| Face plate model No. | F(fix) Hz | F(free) Hz | F(free)/F(fix) | R1 (mm) | R2 (mm) | tb (mm) | ta (mm) | Specific gravity in Central portion | Specific gravity in Peripheral portion | Young's modulus (kgf/sg · mm) | Restitution coefficient |
|---|---|---|---|---|---|---|---|---|---|---|---|
| 1 | 1049 | 2736 | 2.61 | 49.5 | 62.2 | 2.92 | 5.11 | 4.42 | 4.42 | 24396 | 0.913 |
| 2 | 1049 | 2842 | 2.71 | 48.1 | 60.8 | 2.92 | 5.53 | 4.42 | 4.42 | 21741 | 0.92 |
| 3 | 1049 | 3217 | 3.07 | 43.8 | 56.5 | 2.92 | 6.91 | 4.42 | 4.42 | 15170 | 0.946 |
| 4 | 1049 | 3835 | 3.65 | 38.1 | 50.8 | 2.92 | 9.07 | 4.42 | 4.42 | 9820 | 0.966 |
| 5 | 1049 | 4167 | 3.97 | 35 | 47.7 | 2.92 | 10.31 | 4.42 | 4.42 | 7788 | 0.968 |
| 6 | 1049 | 4778 | 4.55 | 30 | 42.7 | 2.92 | 12.75 | 4.42 | 4.42 | 5325 | 0.969 |
| 7 | 1049 | 5476 | 5.22 | 25 | 37.7 | 2.92 | 15.8 | 4.42 | 4.42 | 3452 | 0.969 |
| 8 | 1049 | 6282 | 5.99 | 20 | 32.7 | 2.92 | 19.77 | 4.42 | 4.42 | 2018 | 0.965 |
| 9 | 1239 | 3233 | 2.61 | 49.5 | 62.2 | 2.92 | 5.11 | 4.42 | 4.42 | 34065 | 0.945 |
| 10 | 1194 | 3233 | 2.71 | 48.1 | 60.8 | 2.92 | 5.53 | 4.42 | 4.42 | 28140 | 0.944 |
| 11 | 1054 | 3233 | 3.07 | 43.8 | 56.5 | 2.92 | 6.91 | 4.42 | 4.42 | 15327 | 0.947 |
| 12 | 885 | 3233 | 3.65 | 38.1 | 50.8 | 2.92 | 9.07 | 4.42 | 4.42 | 6977 | 0.958 |
| 13 | 814 | 3233 | 3.97 | 35 | 47.7 | 2.92 | 10.31 | 4.42 | 4.42 | 4686 | 0.961 |
| 14 | 710 | 3233 | 4.55 | 30 | 42.7 | 2.92 | 12.75 | 4.42 | 4.42 | 2438 | 0.963 |
| 15 | 620 | 3233 | 5.22 | 25 | 37.7 | 2.92 | 15.8 | 4.42 | 4.42 | 1204 | 0.964 |
| 16 | 541 | 3233 | 5.98 | 20 | 32.7 | 2.92 | 19.77 | 4.42 | 4.42 | 536 | 0.964 |
| 17 | 400 | 1825 | 4.56 | 20 | 32.7 | 2.92 | 19.77 | 7.7 | 4.13 | 284 | 0.957 |
| 18 | 400 | 1898 | 4.74 | 20 | 32.7 | 2.92 | 19.77 | 7.13 | 4.18 | 285 | 0.958 |
| 19 | 400 | 2147 | 5.37 | 20 | 32.7 | 2.92 | 19.77 | 5.54 | 4.32 | 290 | 0.959 |
| 20 | 400 | 2560 | 6.4 | 20 | 32.7 | 2.92 | 19.77 | 3.86 | 4.47 | 296 | 0.964 |
| 21 | 400 | 2782 | 6.95 | 20 | 32.7 | 2.92 | 19.77 | 3.24 | 4.52 | 298 | 0.967 |
| 22 | 400 | 3186 | 7.96 | 20 | 32.7 | 2.92 | 19.77 | 2.44 | 4.6 | 300 | 0.974 |
| 23 | 400 | 3656 | 9.14 | 20 | 32.7 | 2.92 | 19.77 | 1.81 | 4.65 | 302 | 0.98 |
| 24 | 400 | 4189 | 10.47 | 20 | 32.7 | 2.92 | 19.77 | 1.23 | 4.7 | 304 | 0.985 |
| 25 | 1316 | 6000 | 4.56 | 20 | 32.7 | 2.92 | 19.77 | 7.7 | 4.13 | 3068 | 0.957 |
| 26 | 1268 | 6000 | 4.73 | 20 | 32.7 | 2.92 | 19.77 | 7.13 | 4.18 | 2867 | 0.958 |
| 27 | 1119 | 6000 | 5.36 | 20 | 32.7 | 2.92 | 19.77 | 5.54 | 4.32 | 2269 | 0.962 |
| 28 | 938 | 6000 | 6.39 | 20 | 32.7 | 2.92 | 19.77 | 3.86 | 4.47 | 1625 | 0.968 |
| 29 | 863 | 6000 | 6.95 | 20 | 32,7 | 2.92 | 19.77 | 3.24 | 4.52 | 1385 | 0.971 |
| 30 | 754 | 6000 | 7.96 | 20 | 32.7 | 2.92 | 19.77 | 2.44 | 4.6 | 1065 | 0.975 |
| 31 | 657 | 6000 | 9.13 | 20 | 32.7 | 2.92 | 19.77 | 1.81 | 4.65 | 814 | 0.98 |
| 32 | 573 | 6000 | 10.47 | 20 | 32.7 | 2.92 | 19.77 | 1.23 | 4.7 | 623 | 0.984 |

increases, but it is especially noted that the restitution coefficient is high when compared with the face plate model Nos. 1 to 8.

In the face plate model Nos. 25 to 32, the frequency F(free) of the face plate is set at 6000 Hz which is well over the frequency F(free) of the ball, the frequency F(fix) is varied as explained above. As shown in FIG. 12(*a*), the face plate model Nos. 25 to 32 show that the restitution coefficient has a tendency to increase continuously even when the frequency F(fix) of the face plate is decreased below the frequency F(fix) of the ball (=1041 Hz). Like the face plate model Nos. 9 to 16, the face plate model No. 25 to 32 also show that the restitution coefficient increases as the frequency F(fix) increases, but it is noted that the restitution coefficient is high when compared with the face plate model Nos. 9 to 16.

From these results, the following facts were found. Firstly, the restitution coefficient varies, depending upon both the frequency F(fix) and frequency F(free). Secondary, it is possible to improve the restitution coefficient by adjusting the frequency F(fix), F(free) of the face plate model to the frequency F(fix), F(free) of the golf ball. Thus, the impedance matching theory is right, but it is highly likely that, between the two frequencies F(fix) and F(free), a specific preferable combination exists, by which the restitution coefficient can be more improved. Thirdly, in view of maximizing the restitution coefficient, it is preferable that the frequency F(fix) of the face plate is less than that of the golf ball, and the frequency F(free) of the face plate is more than that of the golf ball, and it is especially desirable to increase the ratio F(free)/F(fix). Lastly, in case of the above-mentioned face plate model or similar structure, the restitution coefficient can be increased by shifting the weight from the central part to the peripheral part to relatively decrease the mass around the impact area.

Spring-Mass Model

In order to ensure the above-mentioned results of the FEM analysis, the inventor further conducted a numerical analysis using spring-mass models which represents a division of the physical object into particles (distributed masses) with springs connecting the particles.

Figure 14:
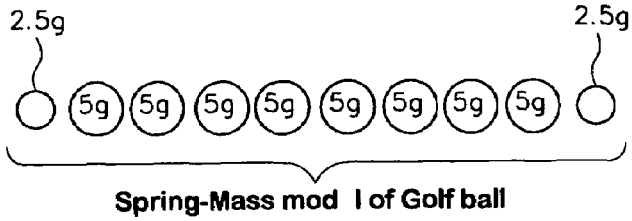
FIG. 14 shows an example of Spring-Mass model of a golf ball.

For the face plate, four spring-mass models having distributed masses shown in FIGS. 13(*a*), 13(*b*), 13(*c*) and 13(*d*) were used. For the golf ball, one spring-mass model having distributed masses shown in FIG. 14 was used.

These models were in collision with each other under the identical conditions to the above FEM analysis. The results are shown in Table 2.

As to the frequency F(fix), F(free) at which the restitution coefficient becomes maximum, the frequency F(fix) became less than that of the golf ball, and the frequency F(free) became more than that of the golf ball. In the spring-Mass models too, the same results as the finite element method could be obtained.

TABLE 2

| Model No. | F(fix) Hz | F(free) Hz | F(free)/F(fix) | Restitution coefficient e |
|---|---|---|---|---|
| 1 | 795 | 3140 | 3.95 | 0.954 |
| 2 | 1655 | 2880 | 1.74 | 0.891 |
| 3 | 1425 | 2845 | 2 | 0.915 |
| 4 | 750 | 3110 | 4.15 | 0.988 |
| Golf ball | 1425 | 2845 | — | — |

Hitherto, it has been considered that the restitution coefficient can be explained based on the mechanical impedance, rigidity and mass. But, as the results of the above-mentioned analyses, it was found that the distribution of the mass is an important parameter to be considered together with the impedance matching theory. Specifically, the rebound performance can be improved when the mass is decreased in the part hit by the ball relatively to the peripheral part. This corresponds to decreasing the frequency F(fix) of the club head while increasing the frequency F(free) of the club head.

Supposedly, by decreasing the mass in the ball hitting part where the vibrational amplitude becomes largest, the internal energy wasted by the vibration is decreased and as a result the kinetic energy transferred from the club to the ball is increased to improve the rebound performance.

According to the above knowledge, concrete examples were made and tested as explained later, and as a result, the beneficial effects of the present invention could be confirmed.

In this embodiment, as described above, the club head 1 is a wood-type hollow metal head.

In order to make it possible to reduce the thickness of the face portion 3 as much as possible, a high-strength low-Young's-modulus metal material is used in the face portion 3. Beta-type titanium alloys such as Ti-6Al-4V and Ti-15V-3Cr-3Al-3Sn, amorphous alloys and the like may be preferably used as the high-strength low-Young's-modulus metal materials.

Incidentally, it is possible to make the face portion 3 out of a different material than other portions, and aside from the above-mentioned materials, various materials may be employed as far as the limitations for the frequency F(fix) and F(free) are satisfied.

The volume of the club head 1 is preferably set in a range of not less than 250 cc, more preferably not less than 300 cc, but not more than 500 cc.

The area of the club face 2 is preferably decreased into a range of not more than 3000 sq.mm, preferably 1300 to 2650 sq.mm in order to improve the rebound performance and prevent the rigidity of the face portion from decreasing excessively.

In the club head 1, the frequency F(fix) and frequency F(free) can be changed almost independently from each other by for example, arranging the thickness distribution and weight distribution of the face portion 3.

By reducing the thickness of the face portion, the rigidity and mass of the face portion are decreased, serving to lower the frequency F(fix).

By shifting the weight reduced in the face portion to the crown portion and/or sole portion, the frequency F(free) may be increased.

If the frequency F(fix) of the club head 1 is less than 200 Hz, there is a tendency for the club face 2 to increase the deformation at impact and damage is liable to occur in the face portion. On the other hand, if the frequency F(fix) exceeds 1400 Hz, the rebound performance decreases.

Preferably, the frequency F(fix) of the club head 1 is set in a range of 200 to 900 Hz, more preferably in a range of 200 to 600 Hz.

If the frequency F(free) of the club head 1 is less than 5000 Hz, the restitution coefficient is not improved correspondingly and there is a tendency for the response (shock) at impact to become too weak or light. On the other hand, if the frequency F(free) exceeds 9000 Hz, there is a tendency for the response (shock) at impact to become too strong or heavy. Preferably, the frequency F(free) of the club head 1 is thus set in a range of 5500 to 8000 HZ, more preferably 6000 to 8000 Hz.

The ratio F(free)/F(fix) of these frequencies F(fix) and F(free) of the club head 1 is preferably set in a range of from 3.6 to 13.0, more preferably 5.0 to 13.0, still more preferably 7.0 to 13.0, yet more preferably 8.0 to 13.0, yet still more preferably 8.0 to 11.5.

In this embodiment, the maximum thickness tf of the face portion 3 is set in a range of not more than 2.8 mm, preferably 1.3 to 2.7 mm, more preferably 1.4 to 2.5 mm, yet still more preferably 1.6 to 2.4 mm.

If the thickness tf is less than 1.3 mm, the durability is liable to become insufficient. If the thickness tf is more than 2.8 mm, it becomes difficult to improve the restitution coefficient.

The face portion 3 in this example has a substantially constant thickness, but it is also possible to vary the thickness. For example, the face portion 3 may be provided with a thicker central part for durability and an annular thin part surrounding the thicker central part in order to adjust or decrease the rigidity of the face portion.

In this embodiment, further, the club head 1 is provided on the inner surface with a rib 9 protruding towards the hollow i from the inner surface and extending annularly through the crown portion 4, sole portion 5 and side portion 6, along a plane substantially parallel with the club face.

Such a construction may serve for decreasing of the frequency F(fix) and increasing of the frequency F(free).

As to the thickness td and width w of the rib 9, if these values are too small, the rib's effect to heighten the frequency F(free) is lessened. If too large, as the club head weight is increased thereby, it become difficult to make a large-sized club head. Therefore, the thickness td of the rib 9 is preferably set in a range of from 2.0 to 15.0 mm, more preferably 5.0 to 10.0 mm. The width w of the rib measured in the back-and-forth direction of the head, is preferably set in a range of from 2.0 to 20.0 mm, more preferably 5.0 to 10.0 mm.

In this example, the rib 9 is disposed at a small distance S of from 1.0 to 7.0 mm from the inner surface 3*i* of the face portion 3, and the rib 9 extends annularly or continuously along the periphery of the club face 2 but it may be broken at one or more positions. If the distance s exceeds 7.0 mm, the frequency F(free) tends to decrease. If the distance S is less than 1.0 mm, it is liable to hinder the decreasing of the frequency F(fix) as the influence on vibrations of the face portion 3 increases.

This construction reduces the collision weight of the face portion 3 relatively to the periphery, and increases the ratio F(free)/F(fix) while serving to optimize the frequencies F(fix) and F(free). Further, this construction may shift the position of the center of gravity of the head towards the club face 2, and decrease the sidespin of the struck ball.

Except for the thickness of the ribbed part, if the thickness tc of the crown portion 4, the thickness (to) of the sole portion 5 and the thickness ts of the side portion 6 are too small, the durability is decreased and cracks become liable to occur. If too large contrary, the weight increases, and the increasing of the frequency F(free) is hindered.

Therefore, the crown portion 4 is formed to have a thickness tc of from 0.8 to 3.0 mm, preferably 0.8 to 1.5 mm, more preferably 1.0 to 1.2 mm.

The sole portion 5 has a thickness (to) of from 1.0 to 3.0 mm, preferably 1.2 to 2.0 mm, more preferably 1.3 to 1.8 mm.

The side portion 6 is formed to have a thickness ts of from 0.8 to 3.0 mm, preferably 1.0 to 2.0 mm, more preferably 1.0 to 1.8 mm.

In the present invention, it will be unavoidable to follow a trail and error process in making the club head, but the above guidance (for example, light-center heavy-periphery mass distribution and thickness distribution, formation of periphery rib 9 and the like) and optional use of the computer analyses as above will certainly and greatly decrease the number of the repetition times.

Comparative Test

According to the specifications shown in Table 3, metal wood-type golf club heads were made and the restitution coefficient was measured.

All the club heads were made of a titanium alloy Ti-6A1-4V using a lost-wax process. The thickness of each portion was adjusted to the above-mentioned specific range by grinding the corresponding portion of the casting. A rib having a width w of 10 mm was formed as shown in FIG. 3. The followings are common specifications to all the heads: real loft angle of 11 degrees, lie angle of 56 degrees, head volume of 300 cc, and total head mass of 195+/−1.0 grams.

The restitution coefficient of each head was obtained by computing the experimental data measured according to the above-mentioned "Procedure for Measuring the velocity Ratio of a club Head for conformance to Rule 4-1e, Appendix II, Revision 2 (Feb. 8, 1999), United states Golf Association".

Figure 15:
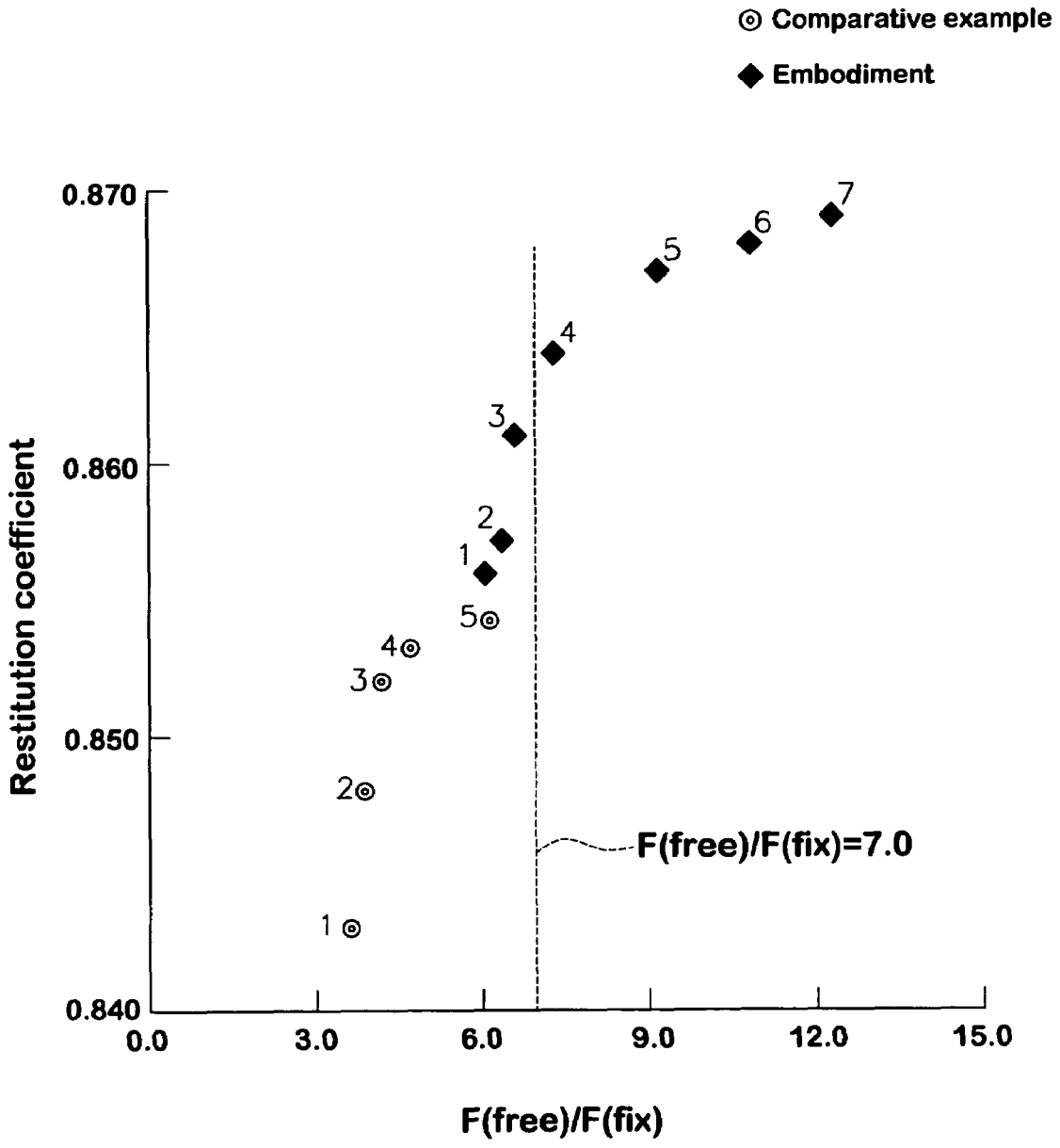
FIG. 15 is a plot of restitution coefficient vs frequency ratio F(fix)/F(free) showing the results of comparison test.

The results are shown in Table 3 and plotted in FIG. 15.

From the test results, it was confirmed that the club heads according to the present invention can be improved in the restitution coefficient.

TABLE 3

| Head | | Ref. 1 | Ref. 2 | Ref. 3 | Ref. 4 | Ref. 5 | Ex. 1 | Ex. 2 | Ex. 3 | Ex. 4 | Ex. 5 | Ex. 6 | Ex. 7 |
|---|---|---|---|---|---|---|---|---|---|---|---|---|---|
| Thickness | | | | | | | | | | | | | |
| Face tf | (mm) | 2.9 | 2.5 | 2.1 | 1.8 | 1.6 | 2.75 | 2.31 | 1.97 | 1.62 | 1.42 | 1.42 | 1.39 |
| Crown tc | (mm) | 0.8 | 0.8 | 0.8 | 0.8 | 0.8 | 0.8 | 0.8 | 0.8 | 0.8 | 0.8 | 0.8 | 0.8 |
| Sole to | (mm) | 1.5 | 1.5 | 1.5 | 1.5 | 1.5 | 1.5 | 1.5 | 1.5 | 1.5 | 1.5 | 1.5 | 1.5 |
| Side ts | (mm) | 1.2 | 1.2 | 1.2 | 1.2 | 1.2 | 1.2 | 1.2 | 1.2 | 1.2 | 1.2 | 1.2 | 1.2 |
| Rib td | (mm) | 2 | 2.21 | 2.42 | 2.51 | 2.58 | 2 | 2.25 | 2.5 | 2.61 | 2.69 | 2.82 | 2.85 |
| Face size | | | | | | | | | | | | | |
| Max. height | (mm) | 46 | 46 | 46 | 46 | 46 | 37 | 37 | 37 | 37 | 37 | 32 | 30 |
| Max. width | (mm) | 84 | 84 | 84 | 84 | 84 | 80 | 80 | 80 | 80 | 80 | 78 | 78 |
| Area | (sq.mm) | 3150 | 3150 | 3150 | 3150 | 3150 | 2620 | 2620 | 2620 | 2620 | 2620 | 2015 | 1340 |
| F(free)/F(fix) | | 3.61 | 3.86 | 4.17 | 4.69 | 6.14 | 6.18 | 6.36 | 6.6 | 7.31 | 9.17 | 10.8 | 22.29 |
| F(fix) | (Hz) | 1110 | 1025 | 920 | 810 | 605 | 1130 | 1010 | 932 | 802 | 601 | 750 | 700 |
| F(free) | (Hz) | 4010 | 3960 | 3840 | 3995 | 3712 | 6980 | 6420 | 6150 | 5860 | 5510 | 8100 | 8600 |

TABLE 3-continued

| Head | | Ref. 1 | Ref. 2 | Ref. 3 | Ref. 4 | Ref. 5 | Ex. 1 | Ex. 2 | Ex. 3 | Ex. 4 | Ex. 5 | Ex. 6 | Ex. 7 |
|---|---|---|---|---|---|---|---|---|---|---|---|---|---|
| First-order frequency *1 | (Hz) | 4010 | 3960 | 3840 | 3795 | 3712 | 4920 | 4752 | 4608 | 4554 | 4454 | 4550 | 4430 |
| Restitution coefficient | | 0.843 | 0.848 | 0.852 | 0.853 | 0.854 | 0.856 | 0.857 | 0.861 | 0.864 | 0.867 | 0.868 | 0.869 |

*1 The first-order frequency means that of the frequency response function obtained by the impact hammer method.

The invention claimed is:

1. A hollow golf club head having a head volume of from 250 cc to 500 cc and comprising a club face portion for hitting a ball, a hollow portion disposed behind the club face portion, and a rib extending annularly through a crown portion, a sole portion and side portion, the rib provided on the inner surface of the head at a distance of from 1.0 to 7.0 mm from the inside of the club face portion, wherein a frequency F(fix) of a local minimum value of the first-order vibration mode in a frequency response function of the club head obtained by vibrating an input point on the club face and measuring the response at an output point on the club face is in a range of from 200 to 1400 Hz, a frequency F(free) of the smallest local minimum value of a frequency response function of the club head obtained by hitting the input point and measuring the response at the output point is in a range of from 5500 to 8000 Hz, and the ratio F(free)/F(fix) of the frequency F(free) to the frequency F(fix) is in a range of from 6.18 to 13.0.

2. The golf club head according to claim 1, wherein the width of the rib measured in the back-and-forth direction of the head, is in a range of from 5.0 to 10.0 mm.

3. A method of making a golf club head having a club face portion for hitting a ball and a hollow portion behind the club face portion, comprising providing a frequency F(fix) of a golf ball, providing a frequency F(free) of the golf ball, selling a frequency F(fix) of the club head in a range of from 200 to 1400 Hz so that the frequency F(fix) of the club head becomes smaller than the frequency F(fix) of the golf ball, setting a frequency F(free) of the club head in a range of from 5000 to 9000 Hz so that the frequency F(free) of the club head becomes larger than the frequency F(free) of the golf ball, and setting the ratio F(free)/F(fix) of the frequency F(free) of the club head to the frequency F(fix) of the club head in a range of from 5.0 to 13.0, wherein the frequency F(fix) is the frequency of a local minimum value of the first-order vibration mode in a frequency response function of the object measured with a vibrator method, and the frequency F(free) is the frequency of the smallest local minimum value of a frequency response function of the object measured with an impact hammer method.

4. The method according to claim 3, which further comprises selecting a value of the area of the club face portion within a range of not more than 3000 sq. mm.

5. A method of making a wood-type golf club head according to claim 3, which further comprises selecting a value of the volume of the head within a range of from 250 cc to 500 cc.

6. A method of designing a golf club head having a club face portion for hitting a ball and a hollow portion behind the club face portion, comprising providing a frequency F(fix) of a golf ball providing a frequency F(free) of the golf ball, setting a frequency F(fix) of the club head in a range of from 200 to 1400 Hz so that the frequency F(fix) of the club head becomes smaller than the frequency F(fix) of the golf ball, setting a frequency F(free) of the club head in a range of from 5000 to 9000 Hz so that the frequency F(free) of the club head becomes larger than the frequency F(free) of the golf ball, and setting the ratio F(free)/F(fix) of the frequency F(free) of the club head to the frequency F(fix) of the club head in a range of from 5.0 to 13.0, wherein the frequency F(fix) is the frequency of a local minimum value of the first-order vibration mode in a frequency response function of the object measured with a vibrator method, and the frequency F(fix) is the frequency of the smallest local minimum value of a frequency response function of the object measured with an impact hammer method.

* * * * *